US008657167B2

(12) United States Patent
Horyna et al.

(10) Patent No.: US 8,657,167 B2
(45) Date of Patent: Feb. 25, 2014

(54) TARGET THROWER MOUNT

(76) Inventors: Edwin L. Horyna, Salina, KS (US); Lon R. Vass, Salina, KS (US)

( * ) Notice: Subject to any disclaimer, the term of this patent is extended or adjusted under 35 U.S.C. 154(b) by 285 days.

(21) Appl. No.: 13/181,943

(22) Filed: Jul. 13, 2011

(65) Prior Publication Data

US 2013/0015222 A1 Jan. 17, 2013

(51) Int. Cl.
*B60R 11/00* (2006.01)

(52) U.S. Cl.
USPC ..... 224/519; 224/525; 224/529; 224/282; 224/545; 224/547; 224/553

(58) Field of Classification Search
USPC ..... 224/401, 420, 519, 521, 525, 529, 455, 224/282, 572, 524, 495, 545, 547, 548, 553, 224/555; 16/382, 387, 388, 252, 253, 16/DIG. 43; 248/674, 300, 345.1
See application file for complete search history.

(56) References Cited

U.S. PATENT DOCUMENTS

| | | | | |
|---|---|---|---|---|
| 5,938,092 | A * | 8/1999 | Johnson | 224/521 |
| 6,662,983 | B2 * | 12/2003 | Lane et al. | 224/405 |
| 2004/0020955 | A1 * | 2/2004 | Darby | 224/485 |
| 2004/0049966 | A1 * | 3/2004 | Highfill et al. | 42/94 |
| 2005/0205630 | A1 * | 9/2005 | Cooper et al. | 224/521 |

* cited by examiner

*Primary Examiner* — Adam Waggenspack
(74) *Attorney, Agent, or Firm* — Hovey Williams LLP

(57) ABSTRACT

A target thrower mount attachable to a hitch on a vehicle. The target thrower mount may comprise a reconfigurable frame having an adjustable height and length and a universal attachment bracket removably attached to the frame. The frame may comprise horizontal and vertical support structures. The universal attachment bracket may comprise an E-shaped bracket and a base plate attached to and spaced apart from the E-shaped bracket. The E-shaped bracket and the base plate may have aligned holes formed therethrough with a configuration that allows attachment of a plurality of types of target throwers. The spacing between the E-shaped bracket and the base plate may also allow for a portion of an attachment piece of some target throwers to be slid therebetween.

17 Claims, 6 Drawing Sheets

TARGET THROWER MOUNT

BACKGROUND

Embodiments of the present invention relate to a target thrower mount for installation on a motor vehicle, such as a pick-up truck.

Many hunters and other sportsman practice their shooting skills by shooting clay pigeons, traps and other targets thrown by target throwers. A target thrower is traditionally mounted on a steel cradle with legs that can be either driven into the ground or bolted to a platform, such as a spare car tire. However, these methods of mounting a target thrower are not always sufficiently stable to compensate for the force of the target thrower's arm. Furthermore, if the ground is hard, it may be difficult to drive the legs into the ground and/or to remove the legs from the ground to relocate to another location.

Accordingly, there is a need for a target thrower mount that overcomes the limitations of the prior art.

SUMMARY

The present invention includes a target thrower mount for attachment to a receiver hitch on a vehicle, such as a pick-up truck. The target thrower mount may comprise an adjustable height and/or length frame and a universal attachment bracket removably connected to the frame and configured to be detachably attached to a target thrower. The frame may comprise a plurality of interchangeable support structures, at least some of which are removably connected to each other and to the hitch. At least one of the support structures may be removed or exchanged for a different one of the support structures to adjust the height of the frame.

In another embodiment of the invention, a target thrower mount may comprise a horizontal support structure connectable to a receiver hitch, a vertical support structure perpendicularly attached to the horizontal support structure, and a universal attachment bracket connected to the vertical support structure. In this embodiment of the invention, the universal attachment bracket may comprise an E-shaped bracket having one or more holes formed therethrough.

In yet another embodiment of the invention, a target thrower mount may comprise a horizontal support structure connectable to a receiver hitch, a vertical support structure removably attached to the horizontal support structure at a perpendicular angle relative thereto, and a universal attachment bracket removably connected to the vertical support structure. In this embodiment of the invention, the universal attachment bracket may comprise an E-shaped plate having a side portion and three spaced-apart flanges extending perpendicularly from the side portion. The flanges may comprise a first outer flange, a middle flange, and a second outer flange. The E-shaped plate may further have two holes formed therethrough proximate to opposing ends of the side portion, one hole formed therethrough proximate to an end of at least one of the outer flanges, and a hole formed through a center of the middle flange. The universal attachment bracket may further comprise a base plate having one or more holes formed therethrough and vertically aligned with one or more of the holes of the E-shaped plate. The base plate may be removably connected to the vertical support structure and spaced apart from and fixed to the E-shaped plate by way of spacers and mechanical fasteners extending through the holes of both the E-shaped plate and the base plate.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 1:
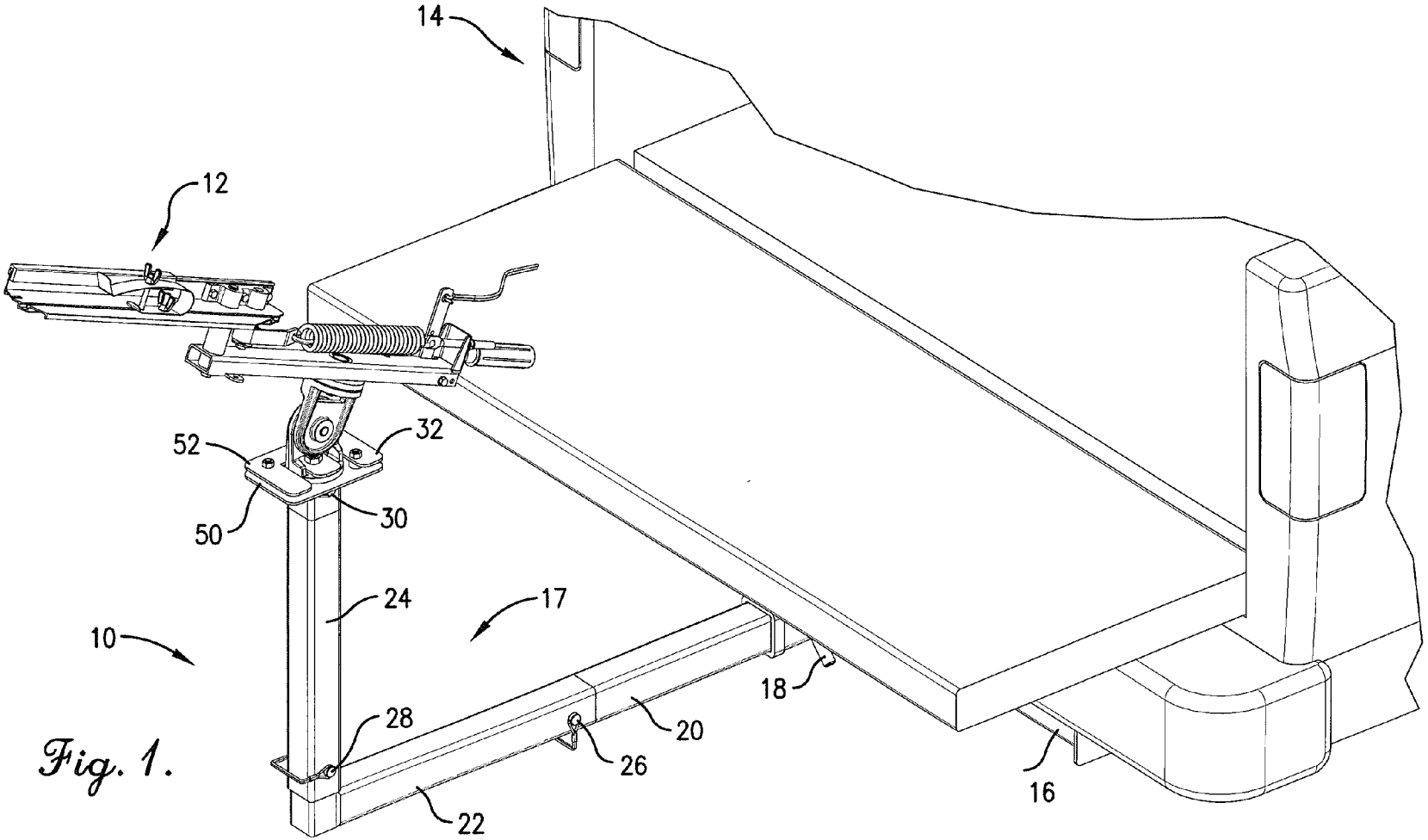
FIG. 1 is a perspective view of a target thrower mount constructed in accordance with an embodiment of the invention and shown attached to a vehicle.

The drawing figures do not limit the present invention to the specific embodiment disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
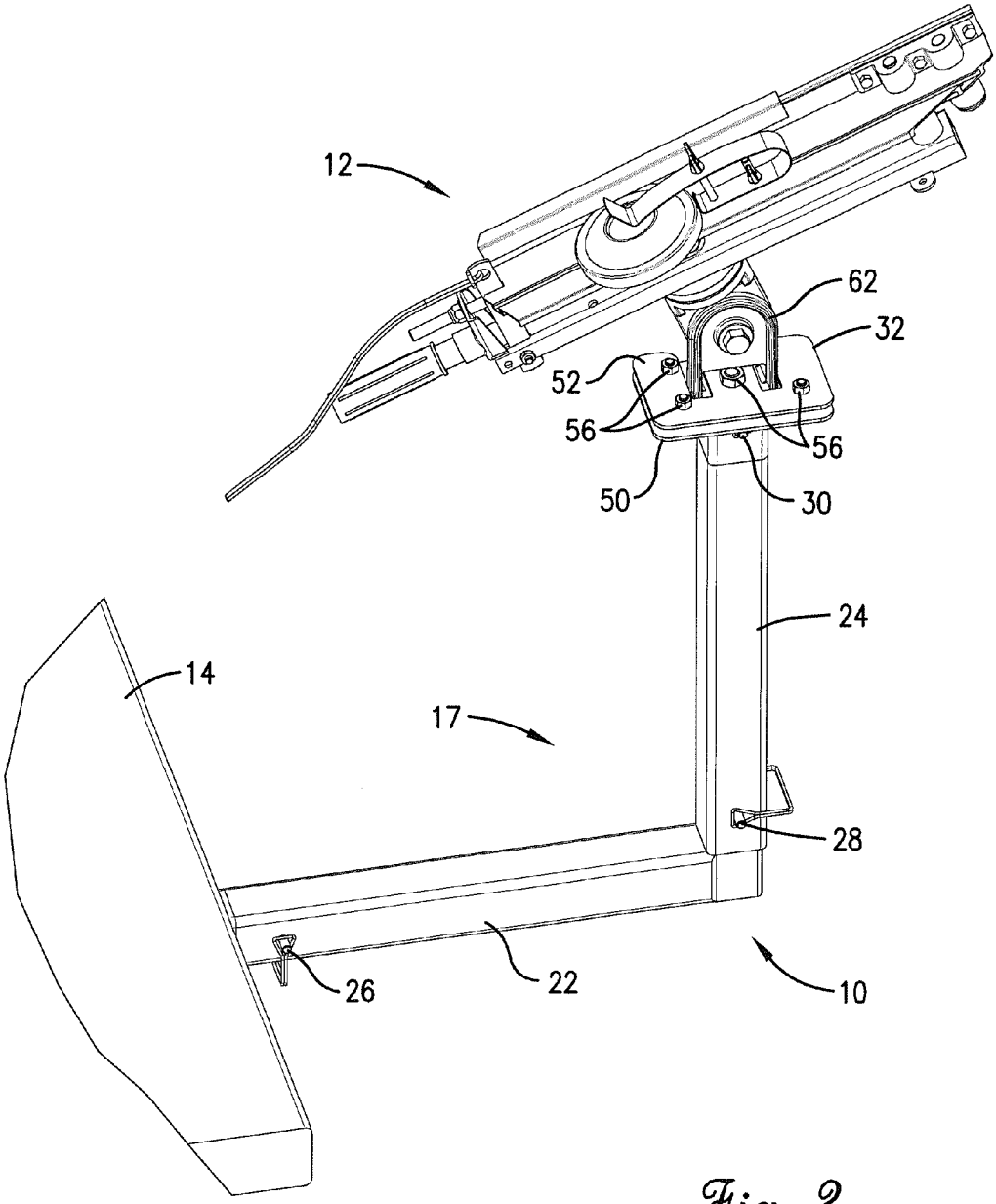
FIG. 2 is another perspective view of the target thrower mount of FIG. 1.
Figure 3:
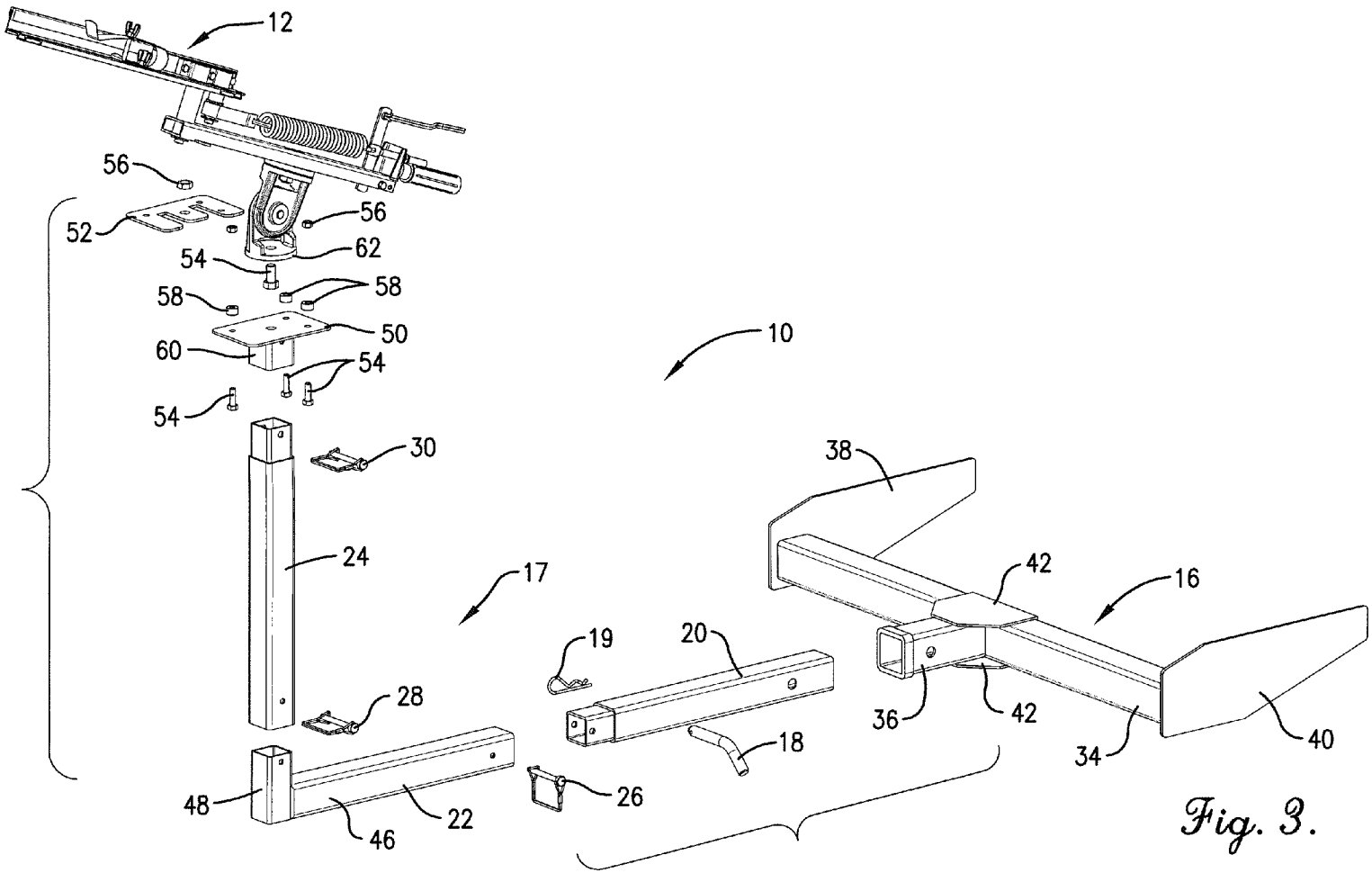
FIG. 3 is an exploded perspective view of the target thrower mount of FIG. 1.

The present invention, as illustrated in FIGS. 1-3, is a mount 10 for a target thrower 12, such as a clay pigeon thrower. The mount 10 may be configured to attach to any vehicle 14, such as a truck, car, sports utility vehicle (SUV), four-wheeler, recreational vehicle (RV), trailer, motor home, and the like. For example, the mount 10 may be configured to attach to a receiver hitch of a pick-up truck, as illustrated in FIG. 1. The target thrower 12 may be any thrower known in the art, such as: DO-ALL Backyard ¾ Clay Hawk, DO-ALL Backyard ¾ Single, DO-ALL Post Mount, DO-ALL Full Trap, DO-ALL Competitor Trap, CHAMPION High Fly String Release, CHAMPION High Fly String Release Jr., HOPPES Clay King, WINCHESTER Clay Target Thrower, TRIUS throwers, and ALLEN Claymaster Clay Target Thrower Trap. Other target throwers not listed herein may also be attached to the mount 10.

The mount 10 may be configured to attach to a hitch 16, such as the receiver hitch illustrated in FIG. 3, and secured thereto by a hitch pin 18. The mount 10 may comprise a frame 17 comprising a plurality of support structures 20,22,24 mechanically attached to each other and attachable to the hitch 16 via the hitch pin 18. The mount may further comprise latch pins 26,28,30 configured to mechanically join the support structures 20-24 together and a universal attachment bracket 32 attached to one of the frame 17 and configured to provide a mechanical attachment for any of a plurality of types or models of target throwers, such as those listed above.

As illustrated in FIG. 3, the mount 10 may be configured to attach to any hitch known in the art, such as a receiver hitch made of metal, composite, or any sufficiently rigid, strong material. For example, the hitch 16 may comprise a parallel support tube 34 and a perpendicular support tube 36 extending perpendicularly to the parallel support tube 34. Furthermore, the hitch 16 may comprise a first end plate 38 and a second end plate 40 attached at opposing ends of the parallel support tube 34, as well as top and bottom plates 42,44 covering a top side and a bottom side of both the parallel support tube 34 and the perpendicular support tube 36 providing structural support between a welded joint of the parallel and perpendicular support tubes 34,36.

The hitch 16 may be configured such that, when attached to the vehicle 14, the parallel support tube 34 is substantially parallel with a back edge of the vehicle 14. The perpendicular support tube 36 may be configured to receive a portion of the frame 17 and may have at least one hole formed therethrough and configured to attach one of the support structures 20-24 to the hitch 16 by way of the hitch pin 18. The hitch pin 18 or another operationally-equivalent mechanical fastener may be slid through aligned or corresponding holes formed through the perpendicular support tube 36 and holes formed through the frame 17. Then a mechanical fastener, such as a hitch pin clip 19, as illustrated in FIG. 3, may secure the hitch pin 18 within these holes.

The frame 17 may have an adjustable height and/or length to allow for standing individuals as well as individuals in wheel chairs to use the mount 10. For example, a height of the mount 10 may be adjusted by adding or removing one or more of the support structures 20-24.

The frame's support structures 20-24 may be a plurality of elongated rigid structures made of metal, composite, or any sufficiently rigid material. For example, the support structures 20-24 may be elongated tubes of any cross-sectional shape. At least some of the support structures 20-24 may have one or more open end portions sized and shaped to slide into another open end of one of the support structures 20-24 and to be mechanically connected therewith. Furthermore, at least some of the support structures 20-24 may be sized and configured to slide into an opening of the hitch 16.

In an example embodiment of the invention, as illustrated in FIGS. 1-3, a first support structure 20 may be connected to the perpendicular support tube 36 of the hitch 16 and a second support structure 22 may be connected to the first support structure 24. Specifically, one end portion of the first support structure 20 may slide into an end of the perpendicular support tube 36 and be held thereto by the insertion of the hitch pin 18. The hitch pin 18 may be inserted through at least one hole formed in the perpendicular support tube 36 and at least one hole formed in the first support structure 20. Likewise, an opposite end portion of the first support structure 20 may be sized to fit within an end of the second support structure 22 and may be attached thereto by the insertion of one of the latch pins 26, mechanically holding the first and second support structures 20,22 together.

As further illustrated in FIGS. 1-3, the first and second support structure 20,22 may extend in a substantially horizontal orientation when attached to the vehicle 14 and/or the hitch 16. In some embodiments of the invention, as illustrated in FIG. 3, the second support structure 22 may comprise a horizontal section 46 and a vertical section 48, which may be a tube welded to or integrally formed with the horizontal section 46 of the second support structure 22. The first and second support structures 20,22 may be individual pieces or may alternatively be formed as one continuous piece (not shown) and may also be referred to herein as a horizontal support structure.

A third support structure 24, also referred to herein as a vertical support structure, may be connected to the vertical section 48 of the second support structure 22 at a substantially right angle relative to the horizontal section 46 of the second support structure 22 and may be substantially perpendicular relative to the first support structure 20. Specifically, the third support structure 24 may have a cross-section slightly larger than a cross-section of at least a portion of the vertical section 48 of the second support structure 22, so that the third support structure 24 may slide thereon. Furthermore, another one of the latch pins 28 may be inserted through holes in the second and third support structures 22,24 which are aligned with each other once the second support structure 22 is slid over the vertical section 48.

The first, second, and third support structures 20-24 illustrated in FIGS. 1-3 are merely examples. Other support structures of varying lengths may also be used to reconfigure the frame 17, thereby lengthening or shortening the horizontal or vertical dimensions of the mount 10. For example, in some embodiments of the invention, the third support structure 22 may be omitted or detached and the universal attachment bracket 32 may be attached directly to the vertical section 48 of the second support structure 22. This example configuration of the invention may be useful for a person in a wheel chair or a shorter individual.

Figure 4:
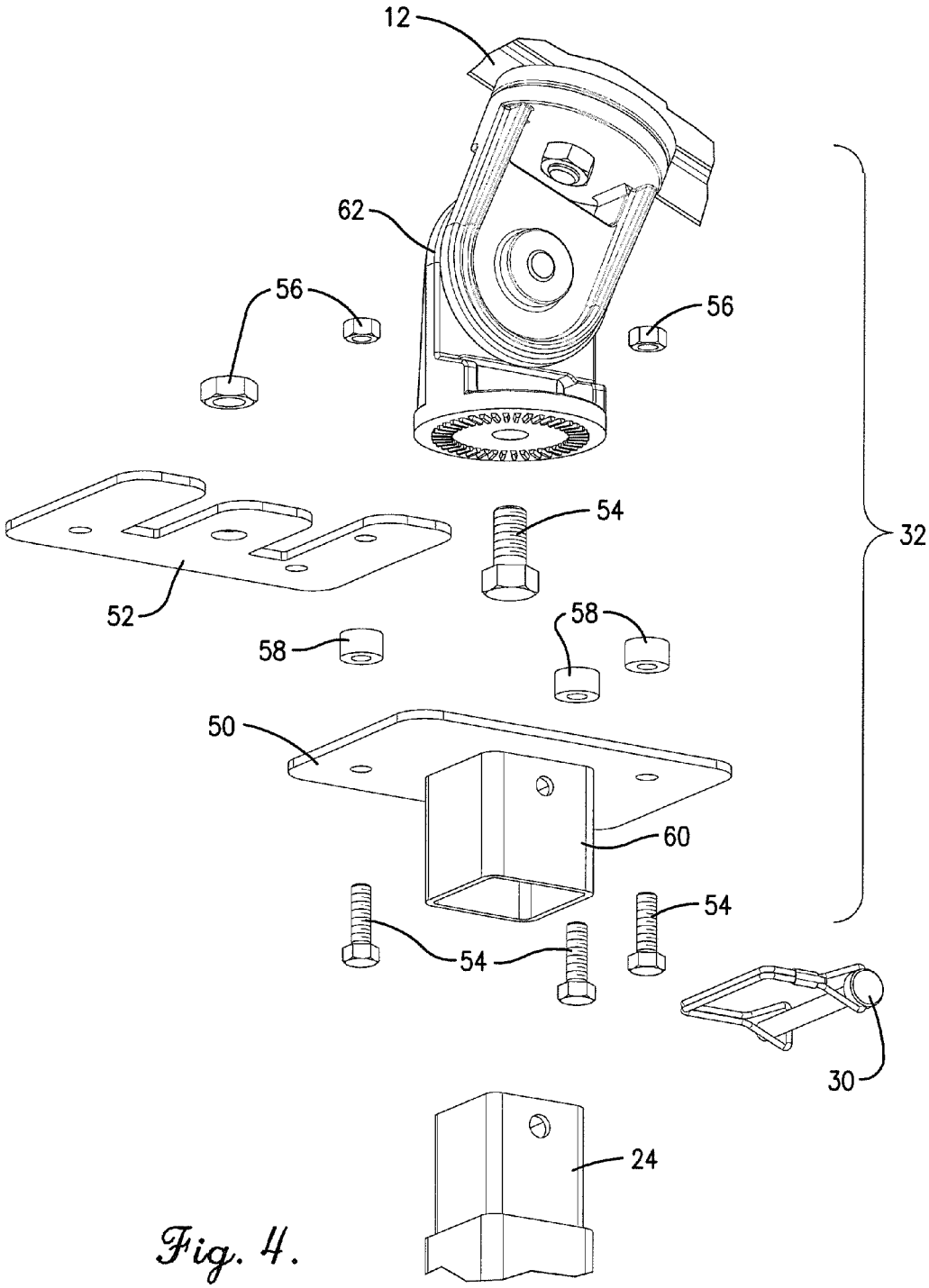
FIG. 4 is an exploded perspective view of a universal attachment bracket of the target thrower mount of FIG. 1.
Figure 6:
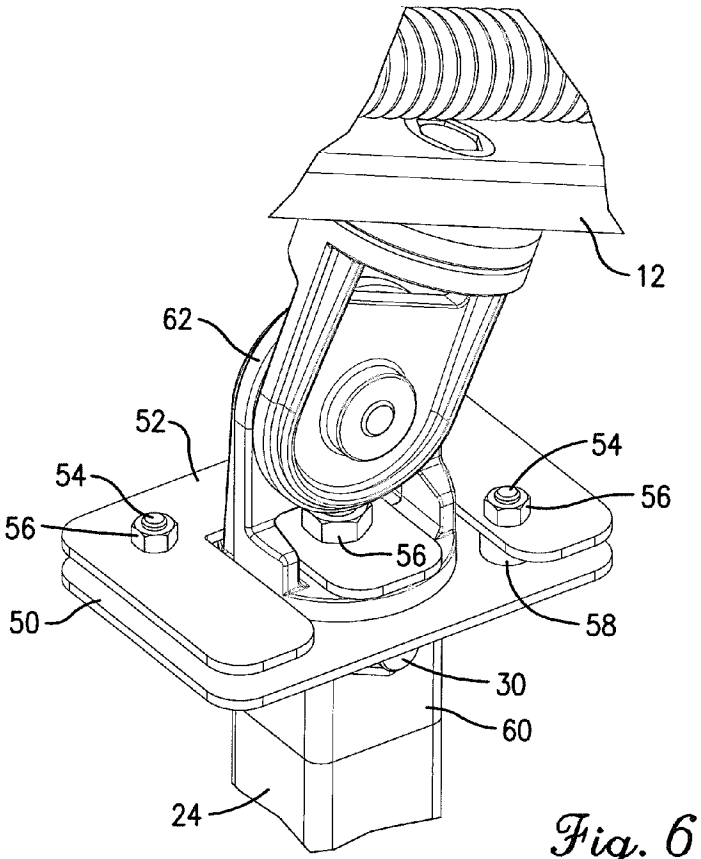
FIG. 6 is another perspective view of the universal attachment bracket of FIG. 4.
Figure 5:
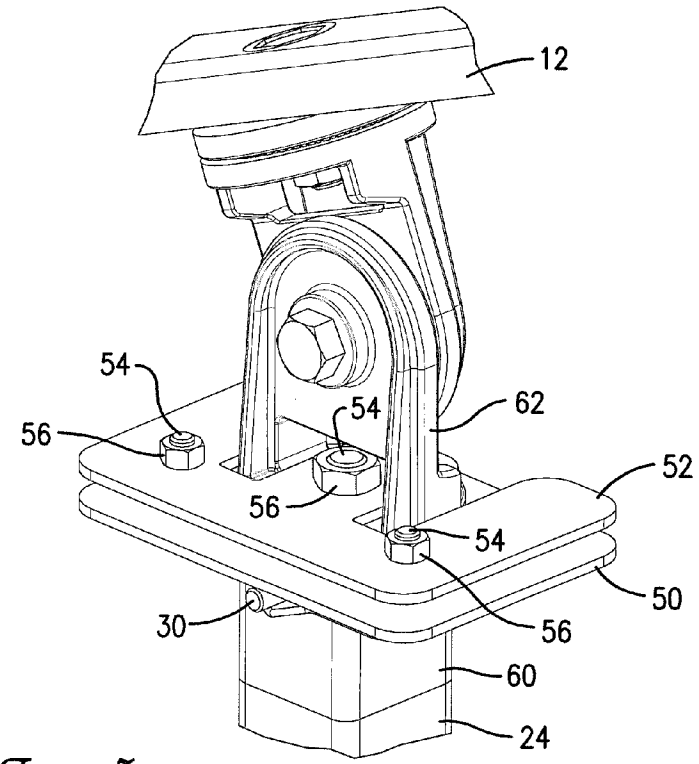
FIG. 5 is a perspective view of the universal attachment bracket of FIG. 4.
Figure 8:
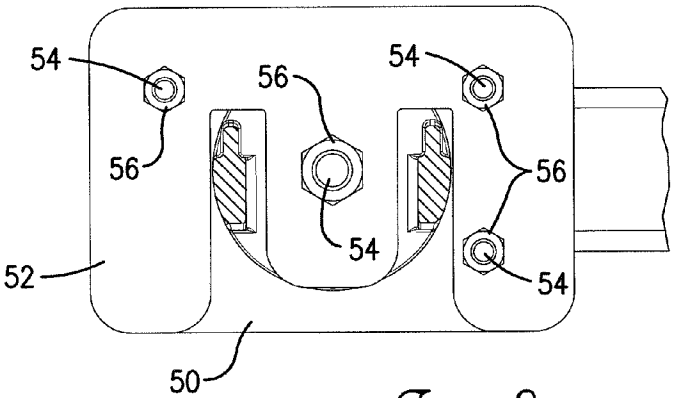
FIG. 8 is a cross-sectional view of the universal attachment bracket of FIG. 7.
Figure 9:
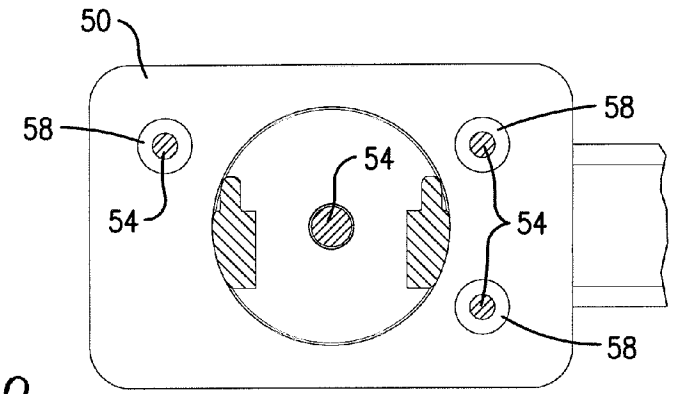
FIG. 9 is a cross-sectional view of the universal attachment bracket of FIG. 7.
Figure 7:
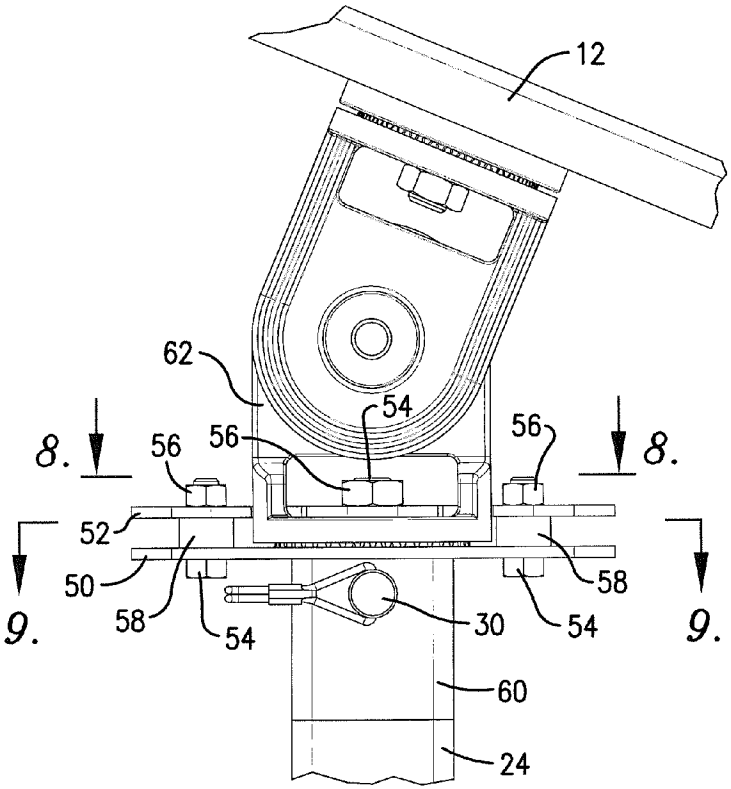
FIG. 7 is a side view of the universal attachment bracket of FIG. 4.

The universal attachment bracket 32 may be configured to attach to and detach from one or more types of target throwers. In some embodiments of the invention, as illustrated in FIGS. 4-9, the universal attachment bracket 32 may comprise a base plate 50 and an E-shaped bracket 52, as well as a plurality of mechanical fasteners 54,56 and spacers 58 joining the base plate 50 to the E-shaped bracket 52 and fixing the E-shaped bracket 52 a distance apart from the base plate 50. In some embodiments of the invention, the universal attachment bracket 32 may also comprise a support portion 60 integral with or attached to the base plate 50 and configured to mate with and/or be mechanically attached to one of the support structures 20-24. For example, the support portion 60 of the universal attachment bracket 32 may be configured to slide over an end portion of the third support structure 24 and be attached thereto by way of one of the latch pins 30, as illustrated in FIGS. 4-6. Specifically, holes formed through the support portion 60 may align with holes formed through the third support structure 24 and one of the latch pins 30 may be inserted therethrough to connect the universal attachment bracket 32 to the support structures 20-24. In some embodiments of the invention, the third support structure 24 may be omitted or removable, such that the universal attachment bracket 32 may be connected directly with the vertical section 48 of the second support structure 22, as described above.

The E-shaped bracket 52 may be a rigid plate substantially shaped like a capital letter "E", including three spaced apart, parallel flange portions extending substantially perpendicularly from a side portion. For example, flange portions may include a first outer flange, a middle flange, and a second outer flange. The E-shaped bracket 52 may have a plurality of holes formed therethrough which may align with a plurality of holes formed through the base plate 50. For example, the E-shaped bracket 52 may have two holes formed therethrough proximate to opposing ends of the side portion, one hole formed therethrough proximate to an end of at least one of the outer flanges, and a hole formed through a center of the middle flange.

To assemble the universal attachment bracket 32, the holes of the E-shaped bracket 52 may be aligned with the holes of the base plate 50 and the spacers 58 may be placed between the base plate 50 and the E-shaped bracket 52. Then, a first type of mechanical fastener 54, such as screws, bolts, or the equivalent, may be placed through each pair of aligned holes. The first type of mechanical fastener 54 may be secured in place by a second type of mechanical faster 56, such as nuts or other such securing devices, as illustrated in FIGS. 3-9.

A method of mounting the thrower 12 to the mount 10 may vary depending on the specific brand or model of the thrower 12. For example, CHAMPION and DO-ALL throwers may have an attachment piece 62 configured to slide around the middle flange of the E-shaped bracket 52, with a portion thereof resting between the E-shaped bracket 52 and the base plate 50 of the universal attachment bracket 32, as illustrated in FIGS. 4-9. A hole formed through the attachment piece 62 of the thrower 12 in this configuration may also be aligned with the hole extending through the center of the middle flange of the E-shaped bracket 52. In this configuration, the first type of mechanical fastener 54 extending therethrough may also extend through the hole of the attachment piece 62, joining the thrower 12 with the mount 10.

An alternative target thrower (not shown) with at least three mounting holes formed through its attachment piece (not shown) may be attached to the mount 10 by being placed against a top side of the E-shaped bracket 52, aligning its holes with three holes formed through the E-shaped bracket 52, and placing the first type of mechanical fasteners 54 therethrough to mechanically connect the universal attachment bracket 32 with the alternative target thrower. For example, the attachment piece in this alternative configuration may be substantially L-shaped with holes formed proximate both ends thereof and proximate to an angle thereof at which two flanges of the L-shaped attachment piece meet. These holes may be aligned with the two holes formed through the side portion and one of the holes formed proximate to an end of one of the outer flanges of the E-shaped bracket 52.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A target thrower mount for attachment to a receiver hitch on a vehicle, the mount comprising:

a frame configured to detachably attach to the receiver hitch, wherein the frame has at least one of an adjustable height and an adjustable length, wherein the frame is reconfigurable to accommodate for users of different heights or a user in a wheel chair;

a universal attachment bracket detachably attached to the frame and configured to be detachably attached to a target thrower, the universal attachment bracket comprising an E-shaped bracket having one or more holes formed therethrough; and a base plate having one or more holes formed therethrough and vertically aligned with the one or more holes of the E-shaped bracket, wherein the base plate is connected to the frame, wherein the E-shaped bracket is spaced apart from and fixed to the base plate by way of spacers and mechanical fasteners extending through the one or more holes of both the E-shaped bracket and the base plate.

2. The target thrower mount of claim 1, wherein the frame comprises a plurality of interchangeable support structures, at least some of which are removably connected to each other, such that at least one of the support structures can be omitted or exchanged for a different one of the support structures to adjust the height of the frame.

3. The target thrower mount of claim 1, wherein the E-shaped bracket comprises a side portion and three spaced-apart flanges extending perpendicularly from the side portion, the flanges comprising a first outer flange, a middle flange, and a second outer flange, wherein two holes are formed through the side portion proximate to opposing ends thereof, one hole is formed through and proximate to an end of at least one of the outer flanges, and a hole is formed through a center of the middle flange.

4. The target thrower mount of claim 1, wherein the frame comprises a horizontal support structure attachable to the receiver hitch and a vertical support structure removably attached to the horizontal support structure and extending at a substantially right angle relative to the horizontal support structure, wherein the vertical support structure is also removably attachable to the universal attachment bracket.

5. The target thrower of claim 4, wherein the horizontal support structure is further configured to removably attach to the universal attachment bracket when the vertical support structure is removed from both the horizontal support structure and the universal attachment bracket.

6. The target thrower of claim 1, wherein the frame comprises a first support structure attachable to the receiver hitch, a second support structure laterally connected to the first support structure, and a third support structure perpendicularly connected to the second support structure and connected to the universal attachment bracket.

7. The target thrower of claim 6, wherein the support structures are each configured to slide into and/or over another one of the support structures and are joined by way of a latch pin.

8. A target thrower mount, the mount comprising:

a horizontal support structure configured to attach to a receiver hitch;

a vertical support structure fixed substantially perpendicular relative to the horizontal support structure; and a universal attachment bracket connected to one of the support structures, the universal attachment bracket comprising:

an E-shaped bracket having one or more holes formed therethrough; and a base plate having one or more holes formed therethrough and vertically aligned with the one or more holes of the E-shaped bracket, wherein the base plate is connected to one of the support structures and is spaced apart from and fixed to the E-shaped bracket by way of spacers and mechanical fasteners extending through the one or more holes of both the E-shaped bracket and the base plate.

9. The target thrower mount of claim 8, wherein the E-shaped bracket comprises a side portion and three spaced-apart flanges extending perpendicularly from the side portion, the flanges comprising a first outer flange, a middle flange, and a second outer flange, wherein two holes are formed proximate to opposing ends of the side portion, one hole is formed proximate to an end of at least one of the outer flanges, and a hole is formed through a center of the middle flange.

10. The target thrower mount of claim 8, wherein the vertical support structure is removably attached to the horizontal support structure and the universal attachment bracket, and the horizontal support structure is configured to removably attach to the universal attachment bracket when the vertical support structure is removed from both the horizontal support structure and the universal attachment bracket.

11. The target thrower of claim 8, wherein the horizontal support structure comprises a first support structure attachable to the receiver hitch, and a second support structure laterally connected to the first support structure, wherein the second support structure comprises a vertical section configured to attach to the vertical support structure, such that the vertical support structure is perpendicularly connected to the second support structure.

12. The target thrower of claim 8, wherein the support structures are hollow, rigid, elongated tubes.

13. The target thrower of claim 12, further comprising at least one latch pin, wherein one of the support structures is sized and shaped to slide into and/or over an end portion of another one of the support structures, such that holes of two of the support structures are aligned, and the at least one latch pin is configured to slide through the aligned holes and connect the support structures with each other.

14. A target thrower mount, the mount comprising:

a horizontal support structure connectable to a receiver hitch mounted to a vehicle;

a vertical support structure removably attached to the horizontal support structure at a perpendicular angle relative to the horizontal support structure; and a universal attachment bracket removably attached to the vertical support structure and configured to also attach to the horizontal support structure if the vertical support structure is detached therefrom, the universal attachment bracket comprising:

an E-shaped plate comprising a side portion and three spaced-apart flanges extending perpendicularly from the side portion, the flanges comprising a first outer flange, a middle flange, and a second outer flange, and the E-shaped plate having two holes formed therethrough proximate to opposing ends of the side portion, one hole formed therethrough proximate to an end of at least one of the outer flanges, and a hole formed through a center of the middle flange, and a base plate having one or more holes formed therethrough and vertically aligned with one or more of the holes of the E-shaped plate, wherein the base plate is removably connected to the vertical support structure and is spaced apart from and fixed to the E-shaped plate by way of spacers and mechanical fasteners extending through one or more of the holes of both the E-shaped plate and the base plate.

15. The target thrower of claim 14, wherein the horizontal support structure comprises a first support structure attachable to the hitch, and a second support structure laterally connected to the first support structure, wherein the second support structure comprises a horizontal section attached to the first support structure and a vertical section fixed at a right angle relative to the horizontal section and removably attached to the vertical support structure.

16. The target thrower of claim 14, wherein the support structures are hollow, rigid, elongated tubes sized and shaped to slide into and/or over an end portion of another one of the elongated tubes such that holes of two of the support structures are aligned.

17. The target thrower of claim 16, further comprising at least one latch pin inserted through the aligned holes of the support structures, thereby connecting the support structures with each other.

* * * * *